United States Patent [19]

Cooper, Jr.

[11] 4,286,416

[45] Sep. 1, 1981

[54] SEGMENTED FLEXIBLE HONE

[75] Inventor: Frank W. Cooper, Jr., Monroeville, Pa.

[73] Assignee: Westinghouse Electric Corp., Pittsburgh, Pa.

[21] Appl. No.: 930,076

[22] Filed: Aug. 1, 1978

[51] Int. Cl.[2] ..... B24B 33/02

[52] U.S. Cl. ..... 51/334; 15/104.1 R; 51/266; 51/404

[58] Field of Search ..... 15/104.04, 104.09, 104.1 R, 15/104.11, 104.2; 51/266, 267, 281 P, 290, 322, 330, 331, 332, 334, 344, 400, 401, 404; 134/166 C, 167 C, 168 C, 169 C

[56] References Cited

U.S. PATENT DOCUMENTS

| | | | |
|---|---|---|---|
| 1,476,927 | 12/1923 | Schumann | 51/344 X |
| 1,796,060 | 3/1931 | Summers | 51/344 |
| 2,316,257 | 4/1943 | Krastin . | |
| 2,445,492 | 7/1948 | Pentecost . | |
| 2,661,494 | 12/1953 | Crookston et al. | 15/104.1 R X |
| 3,056,700 | 10/1962 | Osterlin . | |
| 3,104,409 | 9/1963 | West . | |
| 3,154,894 | 11/1964 | Dawkins | 51/267 X |
| 3,229,427 | 1/1966 | Goohew | 51/267 X |
| 3,324,603 | 6/1967 | Niemiec | 51/267 X |
| 3,384,915 | 5/1968 | Rands . | |
| 3,724,140 | 4/1973 | Harper | 51/332 |
| 3,871,139 | 3/1975 | Rands | 51/334 |

OTHER PUBLICATIONS

*The New American Machinist's Handbook*, McGraw-Hill, N. Y., 1955, pp. 2–33.

*Primary Examiner*—Gary L. Smith
*Assistant Examiner*—Robert P. Olszewski
*Attorney, Agent, or Firm*—L. A. DePaul

[57] ABSTRACT

The segmented flexible hone comprises spirally wound high pressure tubing for conducting a lubricant therethrough with multiple bristled segments for contacting the inner surfaces of tubular holes so that contaminants and metal may be removed from the inner surfaces of the tubular holes. The bristled segments comprise compliant nylon bristles having enlarged abrasive globules attached to the outer end of the bristles in a non-flaking and a non-chipping manner. The bristled segments are separated by intervals along the high pressure tubing wherein no bristles are disposed but wherein the tubing has holes so that a lubricant mist may exit at high pressures and in a mist therefrom. The segmented flexible hone may be attached to a high pressure lubricant source and a mechanism for rotating the hone such that the ends of the bristles contact the inner surfaces of the members to be honed while a mist of lubricant is emitted from the holes in the high pressure tubing.

10 Claims, 3 Drawing Figures

SEGMENTED FLEXIBLE HONE

BACKGROUND OF THE INVENTION

This invention relates to abrasive hones and particularly to segmented abrasive hones having a lubricating mechanism.

A typical nuclear steam generator comprises a vertically oriented shell, a plurality of U-shaped tubes disposed in the shell so as to form a tube bundle, a tube sheet for supporting the tubes at the ends opposite the U-like curvature, and a dividing plate that cooperates with the tube sheet forming a primary fluid inlet plenum at one end of the tube bundle and a primary fluid outlet plenum at the other end of the tube bundle. The primary fluid having been heated by circulation through the nuclear reactor core enters the steam generator through the primary fluid inlet plenum. From the primary fluid inlet plenum, the primary fluid flows upwardly through first openings in the U-tubes near the tube sheet which supports the tubes, through the U-tube curvature downwardly through second openings in the U-tubes near the tube sheet, and into the primary fluid outlet plenum. At the same time, a secondary fluid known as feedwater, is circulated around the U-tubes in heat transfer relationship therewith, thereby transferring heat from the primary fluid in the tubes to the secondary fluid surrounding the tubes causing a portion of the secondary fluid to be converted to steam. Since the primary fluid contains radioactive particles and is isolated from the secondary fluid by the U-tube walls and the tube sheet, it is important that the U-tubes and the tube sheet be maintained defect-free so that no breaks will occur in the U-tubes or in the welds between the U-tubes and tube sheet, thus preventing contamination of the secondary fluid by the primary fluid.

Occasionally, one or more of the heat transfer tubes may become internally dented due to a variety of possible reasons. One such reason for the internal denting is thought to be corrosion on the outside of the tube which presses in on the tube and causes the internal flow area of the tube to become constricted. Not only does this denting phenomenon restrict the flow through the particular heat transfer tube, but it also may lead to a failure in the tube at the point of denting which may allow the primary fluid to leak into the secondary fluid thus contaminating the secondary fluid. Of course, contamination of the secondary fluid must be prevented; therefore, such a dented tube must be repaired or replaced before the denting results in a crack in the tube. When it has been determined that a particular tube in a steam generator must be removed, the tube is cut and removed from its attachment to the tube sheet. Since corrosion products have been deposited between the tube and the tube sheet wherein the tube was positioned, it is necessary to remove the corrosion products from the hole in the tube sheet so that a new tube may be placed therein. Not only is it necessary to remove corrosion products from the hole in the tube sheet, but it sometimes is also necessary to slightly enlarge the hole in the tube sheet so that a new tube may be disposed therein and welded to the tube sheet. There are many devices known in the art for honing holes in tubular members so that the tubular member may be removed of corrosion products or may be enlarged. However, none of these hones have proved to be successful in applications to nuclear apparatus, such as in the replacement of tubes in nuclear steam generators. Because of the highly radioactive environment present in a nuclear steam generator, it is extremely important that the hone be able to remove the corrosion in a short amount of time and without failing. In addition, the tube sheet of a nuclear steam generator may have holes therein in excess of 20 inches in length that must be honed in a relatively short amount of time. Because of the high temperatures generated and because of the amount of corrosion encountered, the hones available to date were not capable of honing the holes in a tube sheet of a nuclear steam generator in a short period of time and without failing.

In U.S. Pat. No. 3,871,139 issued Mar. 18, 1975 in the name of Steven A. Rands, there is described a multiple-compliant-bristle, self-centering, self-sizing rotary abrasive hone made of multiple outwardly extending, flexible, extremely compliant plastic bristles having enlarged abrasive globules completely firmly attached to the outer ends of the bristles in a non-flaking and non-chipping manner. According to the patent to Rands, the hone is suitable for insertion into a recess or hole in a workpiece which is to be honed by relative movement of the abrasive hone with respect thereto. While the patent to Rands does describe a particular rotary hone, it does not teach a segmented flexible hone wherein a lubricant is conducted through the support for the bristles.

Therefore, what is needed is a segmented flexible hone capable of self-lubrication and of honing large sections of tubular members in an environment wherein human access is limited.

SUMMARY OF THE INVENTION

The segmented flexible hone comprises compliant abrasive bristles mounted on a helically wound high pressure tubular member. The bristled segments are separated by intervals wherein there are no bristles but wherein the tubular member has holes for emitting a mist of lubricant. The lubricant is emitted at high pressures while the hone is being rotated and while the bristled portion is in contact with the member to be honed. The lubricant interacts with the bristled portion and the member to be honed so as to prolong the life of the bristled portion. In addition, the several segments of bristles provide the capability of honing a larger section of the member.

BRIEF DESCRIPTION OF THE DRAWINGS

While the specification concludes with claims particularly pointing out and distinctly claiming the subject matter of the invention, it is believed the invention will be better understood from the following description taken in conjunction with the accompanying drawings, wherein:

DESCRIPTION OF THE PREFERRED EMBODIMENT

In a typical steam generator, a tube sheet supports a bundle of heat transfer tubes. Occasionally, it is necessary to hone the holes in the tube sheet so that a new tube may be inserted therein. The invention described herein provides a segmented flexible hone that is capable of being inserted into the holes in the tube sheet so that corrosion products may be removed from the inner surfaces of the holes in the tube sheet and so that the holes in the tube sheet may be enlarged.

Figure 1:
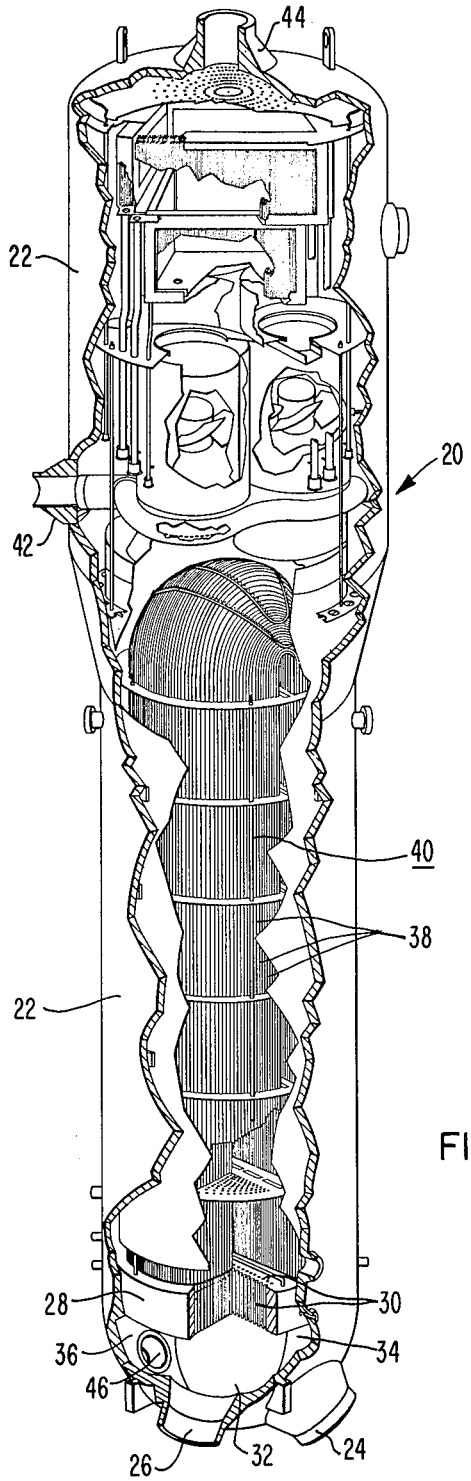
FIG. 1 is a partial cross-sectional view in elevation of a typical steam generator.

Referring to FIG. 1, a nuclear steam generator referred to generally as 20, comprises an outer shell 22 with a primary fluid inlet nozzle 24 and a primary fluid outlet nozzle 26 attached thereto near its lower end. A generally cylindrical tube sheet 28 having tube holes 30 therein is also attached to outer shell 22 near its lower end. A dividing plate 32 attached to both tube sheet 28 and outer shell 22 defines a primary fluid inlet plenum 34 and a primary fluid outlet plenum 36 in the lower end of the steam generator as is well understood in the art. Tubes 38 which are heat transfer tubes shaped with a U-like curvature are disposed within outer shell 22 and attached to tube sheet 28 by means of tube holes 30. Tubes 38 which may number about 7,000 form a tube bundle 40. In addition, a secondary fluid inlet nozzle 42 is disposed on outer shell 22 for providing a secondary fluid such as water while a steam outlet nozzle 44 is attached to the top of outer shell 22. In operation, primary fluid which may be water having been heated by circulation through the nuclear reactor core enters steam generator 20 through primary fluid inlet nozzle 24 and flows into primary fluid inlet plenum 34. From primary fluid inlet plenum 34, the primary fluid flows upwardly through tubes 38 in tube sheet 28, up through the U-shaped curvature of tubes 38, down through tubes 38 and into primary fluid outlet plenum 36 where the primary fluid exits the steam generator through primary fluid outlet nozzle 26. While flowing through tubes 38, heat is transferred from primary fluid to the secondary fluid which surrounds the tubes 38 causing the secondary fluid to vaporize. The resulting steam then exits the steam generator through steam outlet nozzle 44. Manways 46 are provided in outer shell 22 to provide access to both primary fluid inlet plenum 34 and primary fluid outlet plenum 36 so that access may be had to entire tube sheet 28.

In commonly assigned United States Patent application Ser. No. 834,855 filed Sept. 19, 1977 in the name of Blanco et al and entitled "System And Method For Retubing A Steam Generator" there is described a system and a method for replacing the heat transfer tubes of a nuclear steam generator. The method as described therein comprises the steps of cutting at least one large opening in the shell adjacent and above the tube sheet, cutting the upper portion of the shell from the lower portion and removing the former. The method also comprises the steps of severing the tubes above the tube sheet, cutting the dome from the wrapper and removing the dome, and cutting the pads disposed between the wrapper and the shell. The method also includes providing a radiation shield, which will accept the tube bundle and wrapper, lifting the tube bundle and wrapper into the radiation shield, removing the radiation shield, tube bundle and wrapper from the shell, installing a wrapper and new tubes, replacing the dome of the wrapper, and replacing the upper portion of the shell. When a tube 38 of steam generator 20 has been removed from tube holes 30 in tube sheet 28 as described in the Blanco et al application or by other methods, it is sometimes necessary to hone the internal surfaces of tube holes 30 before a new tube 38 is placed therein. The invention described herein provides a mechanism for removing corrosion products from the internal surfaces of tube holes 30 and for enlarging tube holes 30 so that a new tube 38 may be disposed therein.

Figure 2:
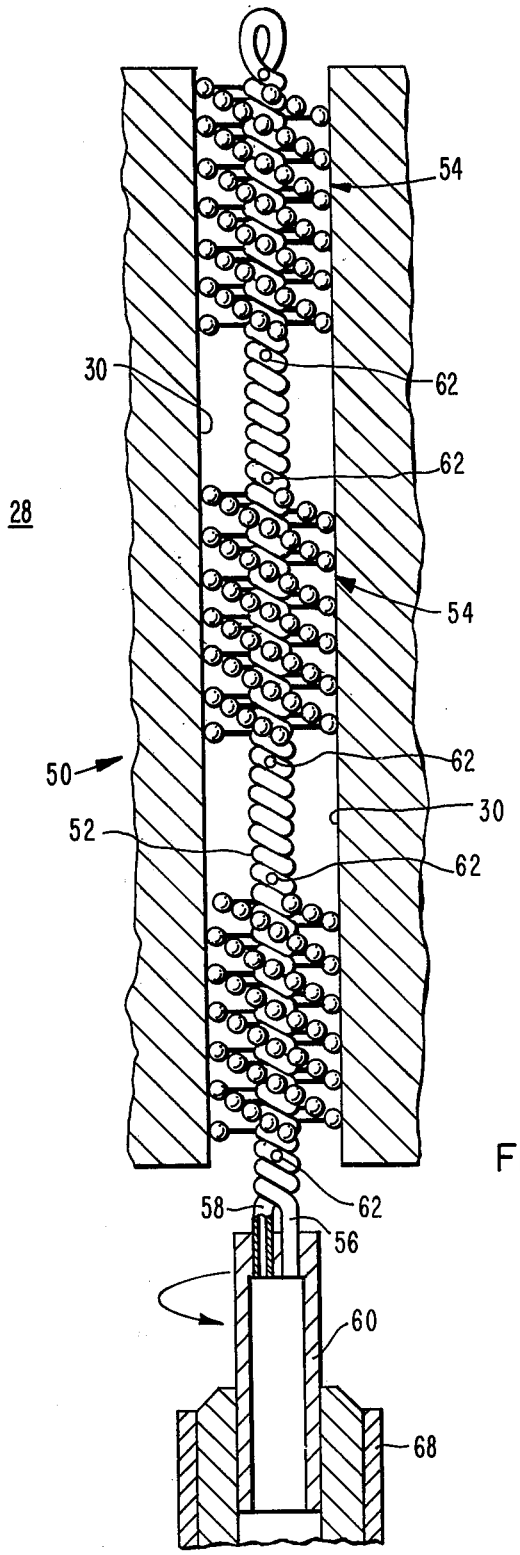
FIG. 2 is a partial cross-sectional view in elevation of the hone disposed in the tube sheet of a nuclear steam generator.
Figure 3:
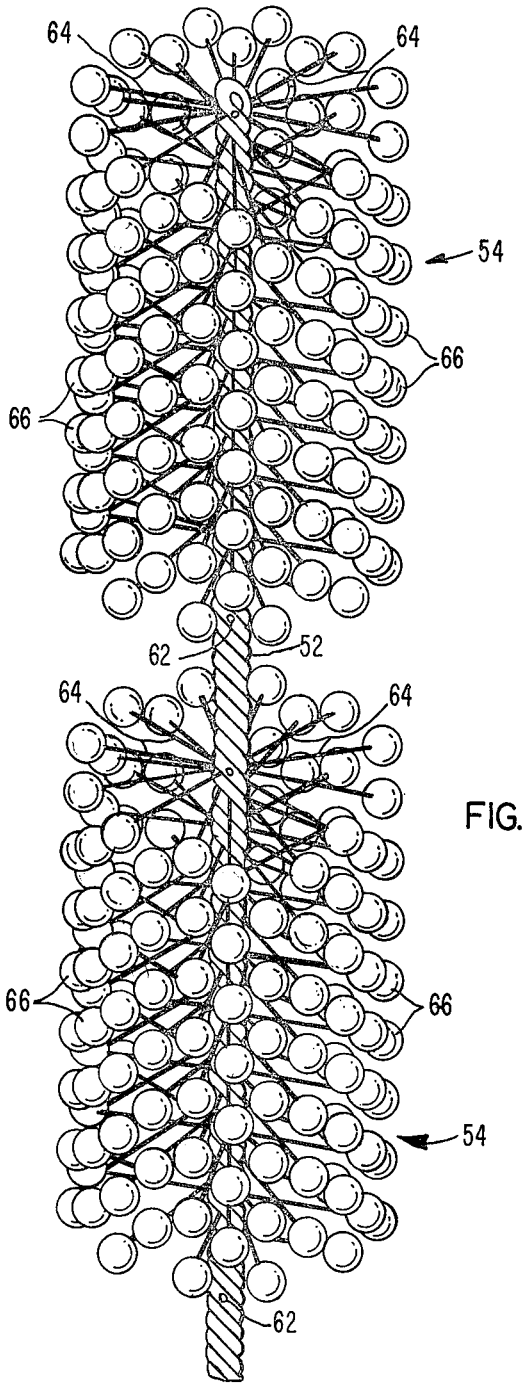
FIG. 3 is a view in perspective of the hone.

Referring now to FIGS. 2 and 3, the segmented flexible hone is referred to generally as 50 and comprises helically wound high pressure tubing 52 which may be manufactured from Series 300 stainless steel tubing and segments of bristles 54 spirally wound and disposed on tubing 52. Tubing 52 has a first end 56 and a second end 58 which are brazed by common brazing methods into a high pressure nozzle 60. Tubing 52 may be wound such that it is a continuous piece of tubing with a first end 56 and a second end 58 being the same tubular member or tubing 52 may be several pieces of tubular members spirally wound together. Tubing 52 may have an outside diameter of approximately 0.125 inch and have a wall thickness of 0.032 inch which is capable of conducting a lubricant at a pressure of between about 80 psi and 2000 psi. As shown in FIG. 2, the bristled segments 54 which may be approximately 4.0 inches in length are separated from each other by an interval of approximately 3.0 inches so that holes 62 may be provided in tubing 52 for emitting a lubricant. Holes 62 may be approximately 0.02 inch in diameter and capable of emitting a lubricant at a pressure between about 80 and about 2000 psi. Holes 62 may also be angled at approximately 30 degrees with respect to the surface of the hole so as to provide better lubrication. The lubricant, which also serves as a coolant, may be water, a water-glycole mixture, alcohol, kerosene, or a honing fluid such as machining oil. Holes 62 are provided in tubing 52 at approximately 0.5 inches above and below the bristled segments 54. Bristled segments 54 may comprise nylon bristles 64 having an abrasive tungsten carbide grit globule 66 held by a resin binder attached to the end of the bristle so as to form an abrasive end for removing corrosion material and enlarging tube holes 30 in tube sheet 28. Nozzle 60 is capable of being disposed in a common chuck mechanism such as the chuck mechanism on a ⅜th inch variable speed drill so as to be able to rotate the segmented flexible hone as hone 50 is disposed in tube hole 30. Nozzle 60 is also capable of being attached to a rotation mechanism 68 that is capable of supplying a lubricant to the interior of nozzle 60 such as the Wilson Tube Cleaning Gun which is commonly used with brushes for supplying a lubricant to the brushes. As segmented flexible hone 50 is rotated within tube holes 30, globules 66 on bristle segments 54 contact the inner surface of tube holes 30 and enlarge the tube hole thus removing corrosion products. As hone 50 is thus rotated, a lubricant such as water is conducted through nozzle 60 and through tubing 52 so that the lubricant is conducted through holes 62 and into contact with the ends of bristles 64, globules 66 in bristled segment 54, and the inside surface of tube holes 30. Because of the size of holes 62 and the pressure under which the lubricant is conducted, the lubricant is emitted from holes 62 in a fine mist which tends to not only lubricate the contact between globules 66 and the inside surface of tube holes 30 but it also acts as a coolant to reduce the temperature of the bristles and globules.

OPERATION

Once a tube 38 has been removed from tube sheet 28 and from tube holes 30 either by conventional methods or as described in the above-identified Blanco et al. application, segmented flexible hone 50 is placed into tube holes 30 in tube sheet 28 either by manual operation or by remotely controlled apparatus. The typical thickness of a tube sheet is approximately 20 to 25 inches while the corroded internal diameter of tube holes 30 may be approximately 0.743 inch. With the segmented flexible hone in position as shown in FIG. 2, the rotation mechanism is activated which causes nozzle 60 to be rotated as shown in FIG. 2. As segmented flexible hone 50 is rotated, the lubricant is conducted through nozzle 60 so as to enter both first end 56 and second end 58 in tubing 52. The lubricant is then conducted through tubing 52 and out holes 62 in a fine mist and under a pressure of between about 80 and 2000 psi. The lubricating mist contacts the bristles, globules, and the internal surface of tube holes as the bristled segments 54 are rotated by the drive mechanism. As segmented flexible hone 50 is thus rotated, it may also be moved in a longitudinal direction so that the entire surface of tube holes 30 may thus be honed. The honing process as described may increase the internal diameter of tube holes 30 to approximately 0.765 inch in as little a time as 40 seconds. Therefore, the invention provides a segmented mist-cooled, flexible hone for honing the tube holes in a tube sheet of a nuclear steam generator so that a new heat transfer tube may be attached therein.

I claim as my invention:

1. A segmented flexible hone comprising:

a high pressure helically wound tubular member having holes disposed therein and capable of being disposed in a tubular hole;

a plurality of outwardly extending flexible spirally wound nylon bristles having abrasive globules attached to the outer ends thereof with the inner ends being attached to said tubular member at segments along said tubular member; said tubular member having intervals free of said bristles with said holes being located in said tubular member in the intervals wherein said tubular member is free of said bristles;

a high pressure nozzle attached to said tubular member at one end thereof for conducting a lubricant through said tubular member and through said holes in said tubular member at a pressure between about 80 psi and about 2000 psi; and a rotational mechanism attached to said nozzle for rotating said tubular member while said lubricant is being conducted therethrough, thereby causing said globules and said lubricant to contact the inside surface of said tubular hole, thus enlarging said tubular hole.

2. The segmented flexible hone according to claim 1 wherein said holes in said tubular member are located approximately 0.5 inch above and below said bristles and said holes are angled at approximately 30 degrees with respect to the surface of the hole.

3. The segmented flexible hone according to claim 2 wherein said holes in said tubular member are approximately 0.013 to 0.20 inch in diameter.

4. The segmented flexible hone according to claim 3 wherein said abrasive globules are tungsten carbine globules held to said nylon bristles by a resin binder.

5. The segmented flexible hone according to claim 4 wherein said tubular member is a 300 Series stainless steel tubular member.

6. The segmented flexible hone according to claim 5 wherein said lubricant is water.

7. The segmented flexible hone according to claim 5 wherein said lubricant is oil.

8. The segmented flexible hone according to claim 5 wherein said lubricant is a water-glycole mixture.

9. The sequential flexible hone according to claim 5 wherein said lubricant is alcohol.

10. The segmented flexible hone according to claim 5 wherein said lubricant is kerosene.

* * * * *